United States Patent [19]

Capasso et al.

[11] Patent Number: 5,045,019

[45] Date of Patent: Sep. 3, 1991

[54] BRA WITH UNDERARM X-FEATURE

[75] Inventors: Ursula Capasso, Hollis; Claudette Goff, New York, both of N.Y.

[73] Assignee: Exquisite Form Industries, Inc., Purchase, N.Y.

[21] Appl. No.: 592,816

[22] Filed: Oct. 4, 1990

[51] Int. Cl.[5] ..... A41C 3/12; A41C 3/00

[52] U.S. Cl. ..... 450/74; 450/1; 450/19; 450/25; 450/65; 2/73

[58] Field of Search ..... 450/1, 19, 20, 21, 59, 450/65, 74, 75, 76, 77, 86; 2/73, 109, 110

[56] References Cited

U.S. PATENT DOCUMENTS

| | | | |
|---|---|---|---|
| 2,484,265 | 10/1949 | Brown | 2/37 |
| 2,541,960 | 2/1951 | Garson | 2/42 |
| 2,632,167 | 3/1953 | Robbins | 450/65 |
| 2,869,554 | 1/1959 | Hollar | 128/498 |
| 2,969,067 | 1/1961 | Smith | 128/489 |
| 3,066,676 | 12/1962 | Kaupp | 450/74 X |
| 3,464,417 | 9/1969 | Zucker | 128/429 |
| 3,516,415 | 6/1970 | Hadley-Webb | 450/65 |
| 3,545,445 | 12/1970 | Freedman | 450/59 |
| 3,566,878 | 3/1971 | Radomski | 450/74 X |
| 3,699,971 | 10/1972 | Hittel et al. | 450/74 X |
| 3,746,007 | 7/1973 | Hand et al. | 2/73 X |
| 3,746,008 | 7/1973 | LoCascio et al. | 128/498 |
| 3,817,255 | 6/1974 | Lo Cascio | 128/498 |
| 4,393,875 | 7/1983 | O'Boyle et al. | 450/1 |
| 4,444,192 | 4/1984 | Stern et al. | 450/74 X |
| 4,453,549 | 6/1984 | Di Tullio | 450/74 |
| 4,470,419 | 9/1984 | Di Tullio | 450/19 |

*Primary Examiner*—Werner H. Schroeder
*Assistant Examiner*—Jeanette E. Chapman
*Attorney, Agent, or Firm*—Bryan, Levitin, Franzino & Rosenberg

[57] ABSTRACT

A brassiere with underarm comfort feature comprises a pair of cup regions to which underarm regions and back regions are connected. An X-crossing or junction is formed by an undercup band which extends under the cup region, and which crosses a lateral band which extends to the side or over the cup region. Upper and lower elastic bands are mounted on opposite sides of an elastic underarm panel which together form the underarm region. Pivoting of the bands which form the X-junction, about the junction, allow the upper and lower side bands to stretch by different amounts to accommodate different proportions for women so that they can wear the bra confortably.

2 Claims, 3 Drawing Sheets

FIG. 4
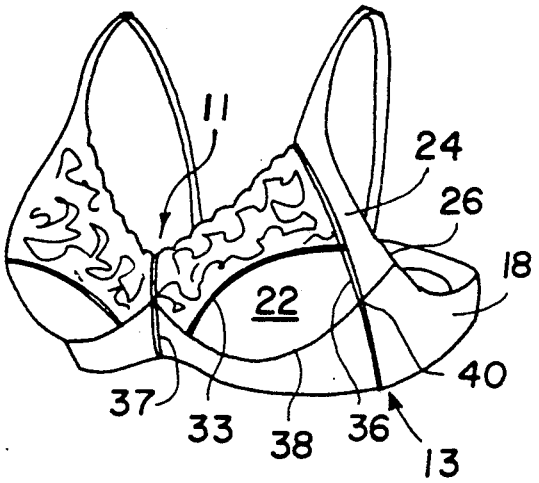
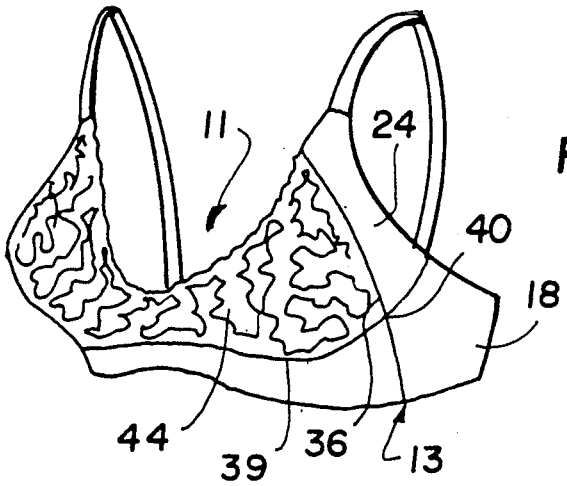
FIG. 5
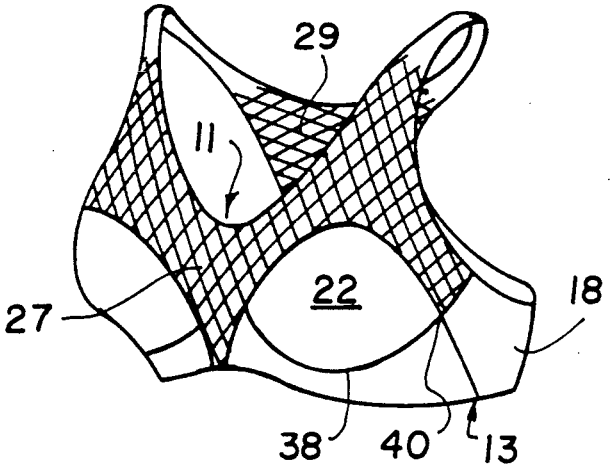
FIG. 6

BRA WITH UNDERARM X-FEATURE

FIELD AND BACKGROUND OF THE INVENTION

The present invention relates in general to brassieres and, in particular to a new and useful bra construction which includes an underarm comfort feature.

U.S. Pat. No. 3,746,008 discloses a brassiere having a dorsal or underarm panel which comprises two pieces of material which have a stretch characteristic in different directions. The two pieces of material are sewn together in a Y-shaped arrangement. This construction is claimed to avoid the unsightly bulge of tissue above the dorsal panel which sometimes results when the brassiere is unbalanced or overly tight. This patent does not however disclose a structure which is capable of providing a differential expansion between upper and lower margins of the dorsal panel to accommodate women having different proportions in these areas.

U.S. Pat. No. 3,817,255 discloses a brassiere having a dorsal panel with stretchable upper and lower margins. The panel is trapezoidal and has no special supporting structure between the dorsal panel and the cup of the bra.

A side or dorsal panel for a brassiere having crossing tapes is disclosed in U.S. Pat. No. 3,464,417. No supporting panel structure is provided above this crossing structure however.

A brassiere with a dorsal panel containing inclined stretch bands is disclosed in U.S. Pat. No. 2,969,067. A similar structure is disclosed in U.S. Pat. No. 2,869,554. A further crossing tape construction for a brassiere is disclosed in U.S. Pat. No. 2,541,960 with a crossing stretch structure in a full body undergarment being disclosed in U.S. Pat. No. 2,484,265.

While many of these earlier patents were directed to structures which improve the comfort and wearability of a brassiere or full body undergarment, none of these patents teach a fully satisfactory structure for adapting to different body types in the areas at the top and bottom of the dorsal or underarm panel for a brassiere.

SUMMARY OF THE INVENTION

The present invention comprises a brassiere with underarm comfort feature which includes an underarm region separated from a cup region of the brassiere by an X junction having crossing arms which respectively extend to the upper and lower margins of the underarm region. The margins are bounded by elastic tapes which can stretch while the arms of the junction are relatively in-elastic. The upper and lower margins of the underarm region can thus stretch to accommodate different body types with the arms of the junction pivoting with respect to each other at the junction. The inelastic nature of the arms maintain support for the garment.

Accordingly, an object of the present invention is to provide a brassiere with underarm comfort feature which comprises: a pair of cup regions each having an inner margin and an outer margin, the inner margins of said cup regions being connected to each other; an underarm region connected to the outer margin of each cup region; said underarm region comprising an elastic underarm panel extending away from said cup region; an elastic upper side band extending along an upper edge of said underarm panel and an outer edge of said cup region; an elastic lower side band extending along a lower edge of said underarm panel and a lower edge of said cup region; a relatively inelastic lateral band extending along said cup region at a location spaced from said upper side band, to said lower side band at a location adjacent the outer margin of said cup region, and between said underarm panel and said cup region, said lateral band being substantially parallel to and spaced from said upper side band in said cup region; and an under-cup band extending along said cup region near said lower side band, between said cup region and said underarm panel and to said upper side band, said lateral band crossing said undercup band at the outer margin of said cup region and intermediate said upper side band and said lower side band so that when said upper and lower side band stretch, said under-cup and lateral bands pivot about said crossing to accommodate women having different figures comfortably.

A further object of the present invention is to provide a brassiere with an underarm feature comfort which is simple in design, durable and comfortable to wear.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 4 is a view similar to FIG. 1 showing the invention incorporated in a basic split cup bra construction;

FIG. 5 is a view similar to FIG. 1 showing the invention incorporated in a lace demi-bra; and FIG. 6 is a view similar to FIG. 1 of the invention incorporated in a sport bra.

DESCRIPTION OF THE PREFERRED EMBODIMENTS

Figure 1:
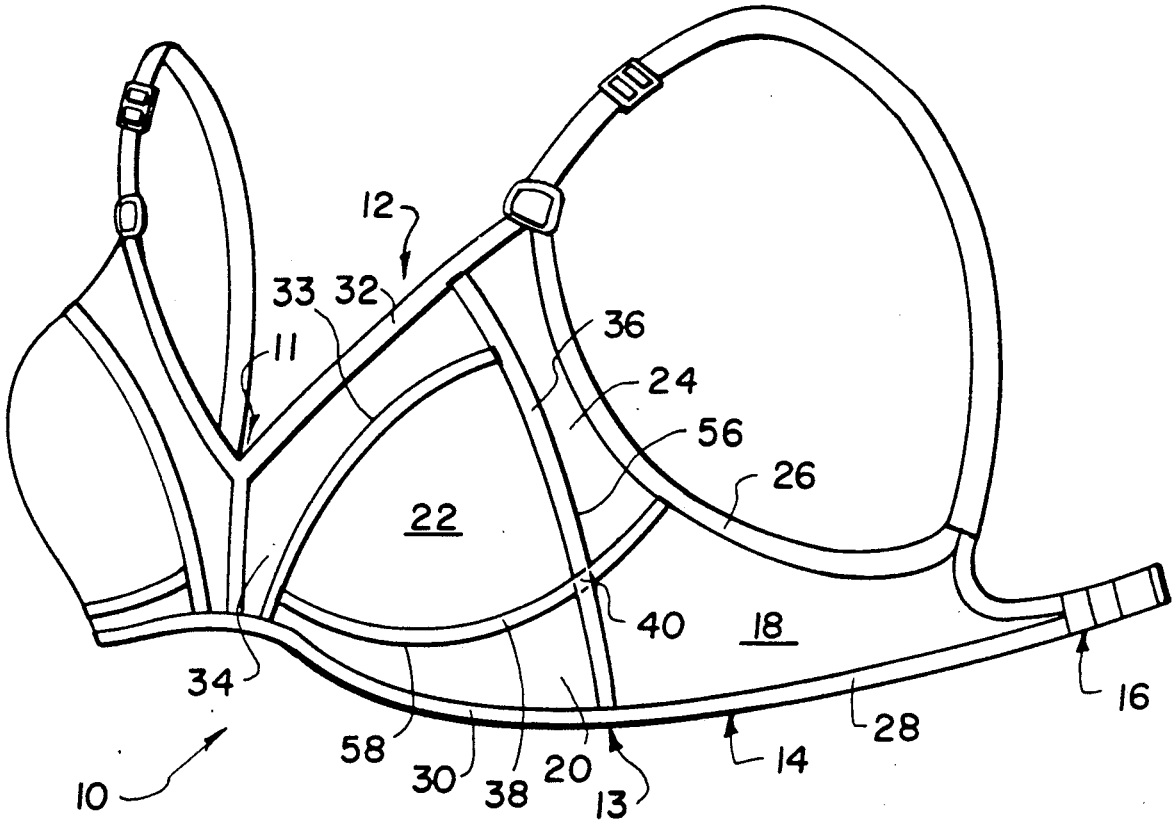
FIG. 1 is a perspective view of a modified A-frame full support bra having the underarm comfort feature of the present invention.

Referring to the drawings in particular, the invention embodied in FIG. 1 comprises a brassiere generally designated 10 having a pair of cup regions generally designated 12, each having an inner margin 11 and an outer margin 13, the outer margins of the cup regions being connected to each other through underarm regions 14, by a back region 16 with hooks and loops or, a continuous back region where the bra is opened by separating the cup regions (in a manner not shown).

The bra 10 includes a pair of the underarm regions connected to the outer margins 13 of the cup regions 12 and positioned between the cup regions and the back region 16.

Each underarm region 14 comprises an elastic underarm panel 18 extending from the cup region 12 to the back region 16. Panel 18 is advantageously made of material that is elastic in all directions.

In the embodiment of FIG. 1, the cup region 12 comprises a relatively inelastic main cup panel 22 having inner, outer and lower edges 33, 56 and 58 respectively.

The cup region 12 also includes an elastic lower cup panel 20 which is connected to the lower edge 58 and an elastic upper cup panel 24 which is connected to the outer edge 56. A relatively inelastic central cup panel 34 is connected to the inner edge 33 of the main cup panel 22 to complete the cup region 12.

An elastic upper side band 26 extends along an upper edge of the underarm panel 18 and an outer edge of the upper cup panel 24, at locations spaced from the outer edge 56 of the main cup panel. A lower elastic side band 28,30 also extends along a lower edge of the underarm panel 18 and a lower edge of the lower cup panel 20. Band 28,30 has a first portion 28 under panel 18 and a second portion 30 under panel 20.

A relatively inelastic upper cup band 32 extends along an upper edge of the central cup panel 34 and along an upper edge of the upper cup panel 24. A relatively inelastic lateral band 36 extends along edge 56 between the upper cup band 32 at a location between the central cup panel 34 and the upper cup panel 24, to the lower band 28,30 at a location between the underarm panel 18 and the lower cup panel 20. The lateral band 36 separates the main cup panel 22 from the upper cup panel 24 and is spaced and substantially parallel to the upper side band 26 as it extends in the cup region 12.

A relatively inelastic under-cup band 38 also extends along lower edge 58 and between the upper cup panel 24 and the underarm panel 18. Band 38 extends to the upper band 26 and separates the upper cup panel from the underarm panel 18.

The crossing relatively inelastic bands 36 and 38 form an X-junction 40 located on the outer margin 13 of the cup region 12 and at an inner edge of the underarm panel 18. The lower band 28, 30 comprises a first lower band portion 28, under the underarm panel 18, and a second lower band portion 30, at the lower edge of the lower cup panel 20. In the embodiment of FIG. 1, the first lower band portion 28 is more elastic than the second lower band portion 30 so that the under region may stretch to accommodate different figures. The junction 40 also permits the bands 36 and 38 to pivot with respect to each other at junction 40 as the lower band 28,30 stretches. This permits free uncoupled stretching between the upper side band 26 and the lower side band 28,30, so that women with different proportions at the upper and lower areas of their underarm region can comfortably wear the bra Although in the embodiment of FIG. 1, the full extent of both bands 36 and 38 are inelastic, for the invention to operate properly, only the legs or portions of the bands extending from the junction 40 and along the edge of panel 18 need be inelastic.

The outer margin 13 of each cup region 12 extends from the lower band 28, 30, along the band 36, to junction 40, then along the band 38 to the upper side band 26 and then along the outer edge of the elastic upper cup panel 24.

As will be explained in connection with the other disclosed embodiments of the invention, other structures such as the central panel 34, the upper band 32 and a separate seam along inner edge 33, can be eliminated without departing from the present invention.

Also the term "band" as used here may include tapes, ribbons or seams in the bra.

In FIGS. 2–6, the same reference numerals are utilized to designate the same or functionally similar parts.

Figure 2:
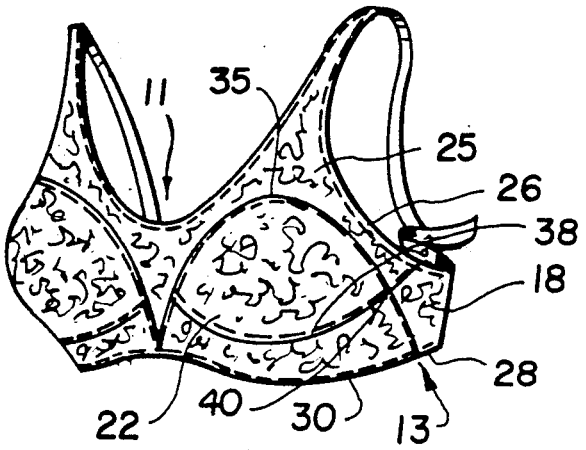
FIG. 2 is a view similar to FIG. 1 with the invention included in a bra with a versatile fit construction.

FIG. 2 illustrates a full, or stretch version or the invention where the junction 40 is formed by an inelastic band 38 which extends under the cup panel 22 from near the center front of the bra, past the junction 40, to the upper side band 26.

The crossing member of junction 40 is formed by a curved over-cup band 35 which extends, near the front center of the bra, from the second lower band portion 30, over the cup panel 20, through the junction 40, to the lower band at its own junction between its first and second band portions 28,30.

Instead of including separate central and upper panels as in the embodiment of FIG. 1, the embodiment of FIG. 2 includes a combined over-cup panel 25 made of stretch fabric.

Figure 3:
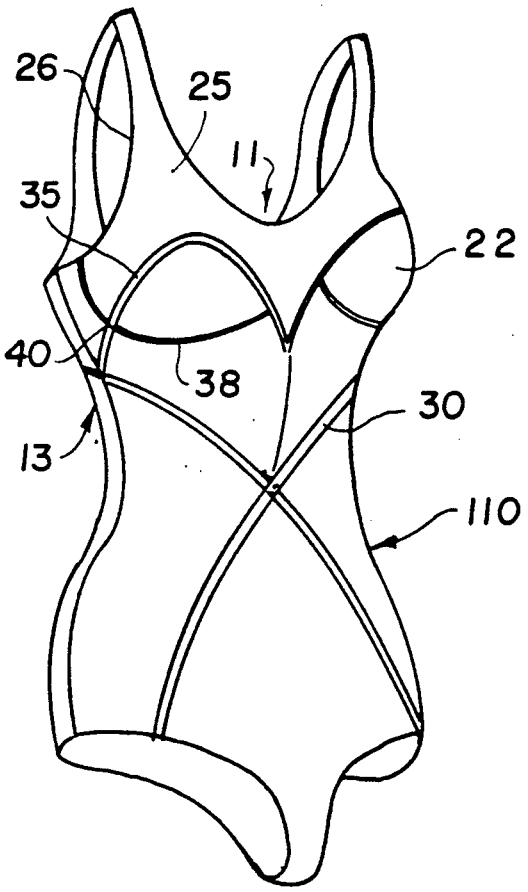
FIG. 3 is a perspective view of a foundation garment including a bra construction with features of the present invention.

FIG. 3 illustrates a support garment generally designated 110 which incorporates the bra construction of the invention. Junction 40 is constructed by crossing bands 35 and 38 in an entirely analogous manner to these bands in the embodiment of FIG. 2.

FIG. 4 illustrates a split cup bra made of lace and tricot wherein junction 40 is formed by an under-cup band 38 which extends from a central split connection 37, under the cup, through the junction 40 and to the elastic upper band 26. Band 36, forming the other member of the junction 40, is analogous to the band 36 in the embodiment of FIG. 1. The embodiment of FIG. 4 does not include an inelastic upper cup band as in the embodiment of FIG. 1, but rather is provided with a lace panel 42 which is separated from cup 22 by a seam 33.

FIG. 5 illustrates a lace demi-bra which is constructed according to the present invention wherein the cup regions are replaced by a low lace panel 44. The upper cup panel 24, as in the embodiment of FIG. 1, is retained as are bands 36 and 38 that form junction 40.

FIG. 6 illustrates a sport version of the invention having a stretch but supportive central and over cup panel 27 which is similar in shape but made of less elastic material than panel 25 of FIG. 2. The bra of FIG. 6 also includes a back panel 29 made of similar resilient supportive material as the panel 27.

While specific embodiments of the invention have been shown and described in detail to illustrate the application of the principles of the invention, it will be understood that the invention may be embodied otherwise without departing from such principles.

What is claimed is:

1. A brassiere (10) with underarm comfort feature, comprising:

a pair of cup regions (12) each having an inner margin and an outer margin, the inner margins of said cup regions being connected to each other;

an underarm region (14) connected to the outer margin of each cup region (12);

a back region (16) connected to each underarm region;

said underarm region (14) comprising an elastic underarm panel (18) extending from said cup region (12) to said back region (16);

said cup region comprising a relatively inelastic main cup panel (22) having inner (33), outer (56) and lower (58) edges, an elastic lower cup panel (20) connected to the lower edge of said main cup panel, an elastic upper cup panel (24) connected to the outer edge of said main cup panel and a relatively inelastic central cup panel (34) connected to the inner edge of said main cup panel;

an elastic upper side band (26) extending along an upper edge of said underarm panel (18) and an outer edge of said upper cup panel (24) at a location spaced from the outer edge (56) of said main cup panel (22);

an elastic lower band (28,30) extending along a lower edge of said underarm panel (18) and a lower edge of said lower cup panel (20);

a relatively inelastic upper cup band (32) extending along an inner edge of said central cup panel (34) and along an upper edge of said upper cup panel (24);

a relatively inelastic lateral band (36) extending between said upper cup band (32) at a location between said central cup panel (34) and said upper cup panel (24), to said lower band (28,30) at a location between said underarm panel (18) and said lower cup panel (20), said lateral band (36) separating said main cup panel (22) from said upper cup panel (24) and being spaced from and parallel to said upper side band (26) in said cup region (12); and a relatively inelastic under-cup band (38) extending along the lower edge of said main cup panel (22) and between said upper cup panel (24) and said underarm panel (18), to said upper side band (26), said lateral band (36) crossing said under-cup band (38) at an X-junction (40) located on the outer margin of said cup region (12) and at an inner edge of said underarm panel (18), intermediate said upper side band (26) and said lower band (28,30);

said lower band (28,30) comprising a first lower band portion (28) at a lower edge of said underarm panel (18), and a second lower band portion (30) at a lower edge of said lower cup panel (20), said first lower band portion (28) being more elastic than said second lower band portion (30).

2. A brassiere (10) with underarm comfort feature, comprising:

a pair of cup regions (12) each having an inner margin (11) and an outer margin (13), the inner margins of said cup regions being connected to each other;

an underarm region (14) connected to the outer margin o each cup region (12);

said underarm region (14) comprising an elastic underarm panel (18) extending away form said cup region (12);

an elastic upper side band (26) extending along an upper edge of said underarm panel (18) and an outer edge of said cup region (12);

an elastic lower side band (28,30) extending along a lower edge of said underarm panel (18) and a lower edge of said cup region (12);

a relatively inelastic lateral band (36) extending along said cup region (12) at a location spaced from said upper side band (26), to said lower band (28,30) at a location adjacent the outer margin of said cup region (12), and between said underarm panel (18) and said cup region (12), said lateral band (36) being substantially parallel to and spaced from said upper side band (26) in said cup region (12);

an under-cup band (38) extending in said cup region near said lower side band (30), and then said under-cup band (38) extends along said outer margin (13), between said cup region (12) and said underarm panel (18), and then to said upper side band (26), said lateral band (36) crossing said undercup band (38) at the outer margin of said cup region (12) and intermediate said upper side band (26) and said lower band (28,30) so that when said upper and lower side bands stretch, said under-cup and lateral bands pivot about said crossing to accommodate women having different figures comfortably, an upper band (32) extending along an upper edge of said cup region, said lateral band (36) extending from said upper cup band at a location spaced from said upper side band (26), through said crossing, to said lower side band (28, 30);

said cup region including a main cup panel (22) having an inner edge (33), a lower edge bounded by said uppercup band (38) and an outer edge bounded by said lateral band (36), said cup region further including a central panel (34) between said inner edge (33) and an upper cup band (32), a lower cup panel (20) under said under-cup band (38) and an upper panel (24) between said lateral band (36) and said upper side band (26); and said lower side band (28, 30) having a first lower band portion (28) under said underarm panel (18), and a second lower band portion (30) under said lower cup panel (20), said first lower band portion (28) being more elastic than said second lower band portion (30).

* * * * *